US009816505B2

(12) United States Patent
Lee et al.

(10) Patent No.: US 9,816,505 B2
(45) Date of Patent: Nov. 14, 2017

(54) SCROLL COMPRESSOR WITH SHAFT ECCENTRIC LUBRICATION

(71) Applicant: LG ELECTRONICS INC., Seoul (KR)

(72) Inventors: Kangwook Lee, Seoul (KR); Taekyoung Kim, Seoul (KR); Cheolhwan Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 367 days.

(21) Appl. No.: 14/591,735

(22) Filed: Jan. 7, 2015

(65) Prior Publication Data

US 2016/0040673 A1 Feb. 11, 2016

(30) Foreign Application Priority Data

Aug. 6, 2014 (KR) ..... 10-2014-0101243

(51) Int. Cl.
*F04C 23/00* (2006.01)
*F04C 29/02* (2006.01)
*F04C 18/02* (2006.01)

(52) U.S. Cl.
CPC ..... *F04C 23/008* (2013.01); *F04C 18/0215* (2013.01); *F04C 29/023* (2013.01); *F04C 29/028* (2013.01); *F04C 2240/603* (2013.01)

(58) Field of Classification Search
CPC F04C 2240/603; F04C 29/023; F04C 29/028; F04C 18/0215; F04C 23/008; F04C 29/02; F04C 29/025; F04C 29/026
See application file for complete search history.

(56) References Cited

U.S. PATENT DOCUMENTS 5,318,425 A * 6/1994 Jetzer ..... F04C 29/023 418/55.6
5,788,470 A * 8/1998 Okuda ..... F01C 1/107 418/55.2

(Continued)

FOREIGN PATENT DOCUMENTS

CN 1126282 7/1996
CN 1715671 1/2006

(Continued)

OTHER PUBLICATIONS

Chinese Office Action dated Mar. 20, 2017 issued in Application No. 201510187640.2 (with English Translation).

*Primary Examiner* — Mary A Davis
(74) *Attorney, Agent, or Firm* — KED & Associates LLP

(57) ABSTRACT

A scroll compressor is provided that may prevent an oil-feeding hole from being blocked due to a high pressure refrigerant, which is compressed in compression chambers and introduced into the oil-feeding hole through an oil-feeding slit, by blocking one of both end portions of the oil-feeding slit, adjacent to the compression chambers, when the oil-feeding hole is formed through an outer circumferential surface of a bearing and the oil-feeding slit, which communicates with the oil-feeding hole, is formed on the outer circumferential surface. This may allow for smooth oil supply onto the outer circumferential surface of the bearing through the oil-feeding hole, thereby enhancing a bearing performance. Also, the oil-feeding hole or slit may be formed at a closest position to an oil feeding-required section, not within the section. This may allow for quick oil supply into the oil feeding-required section, resulting in further enhanced bearing performance.

13 Claims, 12 Drawing Sheets

(56) References Cited

U.S. PATENT DOCUMENTS

| | | | | |
|---|---|---|---|---|
| 7,322,809 | B2 * | 1/2008 | Kitaura | F04C 29/028 418/55.1 |
| 7,614,860 | B2 * | 11/2009 | Yano | F04C 29/023 418/55.1 |
| 2006/0177338 | A1 | 8/2006 | Hwang et al. | |
| 2016/0108917 | A1 * | 4/2016 | Bonnefoi | F04C 29/023 418/55.3 |

FOREIGN PATENT DOCUMENTS

| | | | | |
|---|---|---|---|---|
| CN | 101749246 | | 6/2010 | |
| CN | 103502645 | | 1/2014 | |
| JP | H 07-286586 | | 10/1995 | |
| JP | H 07-332264 | | 12/1995 | |
| JP | H 11-159484 | | 6/1999 | |
| KR | 10-1059880 | B1 | 8/2011 | |
| WO | WO 2015172895 | A1 * | 11/2015 | F04C 29/023 |

* cited by examiner

SCROLL COMPRESSOR WITH SHAFT ECCENTRIC LUBRICATION

CROSS-REFERENCE TO RELATED APPLICATION

Pursuant to 35 U.S.C. §119(a), this application claims priority to Korean Application No. 10-2014-0101243, filed in Korea on Aug. 6, 2014, the contents of which is hereby incorporated by reference herein in its entirety.

BACKGROUND

1. Field

A scroll compressor is disclosed herein.

2. Background

In general, scroll compressors are widely used for refrigerant compression in air-conditioning apparatuses, for example, as they have advantages of obtaining a relatively higher compression ratio compared to other types of compressors, and acquiring a stable torque resulting from smooth strokes for suction, compression, and discharge of the refrigerant. The behavior of the scroll compressor is dependent on shapes of a fixed wrap and an orbiting wrap. The fixed wrap and the orbiting wrap may have a random shape, but typically, they have a shape of an involute curve, which is easy to manufacture. The term "involute" curve refers to a curve corresponding to a track drawn by an end of a thread when unwinding the thread wound around a basic circle with a predetermined radius. When such an involute curve is used, the wrap has a uniform thickness, and a rate of volume change of a compression chamber is constantly maintained. Hence, a number of turns of the wrap is increased to obtain a sufficient compression ratio, which may, however, cause a size of the compressor to be increased corresponding to the increased number of turns of the wrap.

The orbiting scroll typically includes a disk, and the orbiting wrap is located on one side of the disk. A boss is formed at a rear surface of the disk opposite to the side on which the orbiting wrap is formed. The boss is eccentrically connected to a rotational shaft, which is coupled to a rotor of the motor, so as to allow the orbiting scroll to perform an orbiting motion. Such an arrangement allows the orbiting wrap to be formed on almost an entire surface of the disk, thereby reducing a diameter of the disk for obtaining a uniform compression ratio. However, as the orbiting wrap and the boss are spaced from each other in an axial direction, a point of application of a repulsive force of a refrigerant applied upon compression and a point of application of a reaction force, which is opposed to the repulsive force of the refrigerant, are spaced apart from each other in the axial direction. Accordingly, the repulsive force and the reaction force are applied to each other as a torque during operation of the compressor. This causes the orbiting scroll to be inclined, thereby generating more vibration and noise.

To solve this problem, for example, Korean Patent Registration No. 10-1059880 has introduced a scroll compressor in which a coupled portion between a rotational shaft and an orbiting scroll is located on a same plane as an orbiting wrap. This type of scroll compressor can solve the problem that the orbiting scroll is inclined because a point of application of a repulsive force of a refrigerant and a point of application of a reaction force against the repulsive force are opposed to each other at a same height.

Scroll compressors in which an eccentric portion of a rotational shaft and an orbiting wrap of an orbiting scroll are coupled to each other in an overlapping manner are classified into a top compression type scroll compressor, in which a compression unit or device is located above a motor unit or motor, and a bottom compression type scroll compressor, in which the compression unit is located beneath the motor unit.

In structures of the top compression type scroll compressor and the bottom compression type scroll compressor, the rotational shaft is inserted up to a height where it overlaps the orbiting wrap of the orbiting scroll, which results in a reduction in a space for forming the orbiting wrap based on a same disk. Accordingly, to increase a compression ratio with respect to the same disk, a bearing area of a coupled portion between the rotational shaft and the orbiting wrap should be reduced as little as possible, ensuring a high bearing performance of the coupled portion.

In order to increase the bearing performance of the coupled portion between the rotational shaft and the orbiting scroll, a smooth oil supply should be ensured, and this is very important with respect to the reliability of the compressor. For the top compression type scroll compressor, the oil supply may be difficult due to a large distance between an oil storage space and the compression unit, and a great deviation of an amount of oil supplied is caused according to an operating speed of the compressor. On the other hand, for the bottom compression type scroll compressor, a relatively uniform oil supply is enabled in view of a short distance between the oil storage space and the compression unit; however, the oil supply may be structurally difficult.

For example, in a scroll compressor in which an eccentric portion of the rotational shaft and the orbiting wrap of the orbiting scroll overlap each other in a radial direction, a portion compressed by the orbiting scroll and a portion to which oil is fed are not separated from each other, and the eccentric portion of the rotational shaft is coupled to a rotational shaft coupling portion through the disk of the orbiting scroll. This may cause a high pressure refrigerant, leaked from a compression chamber, to be introduced between the eccentric portion and the rotational shaft coupling portion. If an oil-feeding hole connected to an oil passage is formed through an outer circumferential surface of the eccentric portion, the high pressure refrigerant leaked from the compression chamber may block (shield, close) the oil-feeding hole. Accordingly, the oil flowing in the oil passage may fail to flow between the eccentric portion and the rotational shaft coupling portion, thereby delaying the oil supply.

Also, in such a scroll compressor, a repulsive force generated due to a gas force is applied at about a 90° point along a rotational direction of the rotational shaft, based on a line connecting a center of the shaft (or an axial center) and a center of the eccentric portion. Hence, a section with a highest oil pressure distribution, namely, an oil feeding-required section in which the oil supply is needed may be formed in a range of about a 90° point up to a 180° point, along the rotational direction of the rotational shaft from an eccentric direction of the eccentric portion. However, if an outlet of the oil-feeding hole or an oil-feeding slit is located far away from the oil feeding-required section, oil may not quickly move to the oil feeding-required section, thereby causing a bearing performance to be reduced. Meanwhile, if the oil-feeding hole or the oil-feeding slit is formed within the oil feeding-required section, oil may not be sufficiently drawn out due to high internal pressure of the oil feeding-required section, thereby reducing oil supply efficiency.

BRIEF DESCRIPTION OF THE DRAWINGS

Embodiments will be described in detail with reference to the following drawings in which like reference numerals refer to like elements, and wherein:

FIGS. 8 and 9 are longitudinal cross-sectional views illustrating a difference in an oil-feeding performance according to a shape of the oil-feeding slit in the scroll compressor of FIG. 1, wherein FIG. 8 illustrates an oil feed state in a structure in which both end portions of the oil-feeding slit are open, and FIG. 9 illustrates an oil-fed state in a structure in which a lower end of the oil-feeding slit is closed (or shielded);

DETAILED DESCRIPTION

Figure 1:
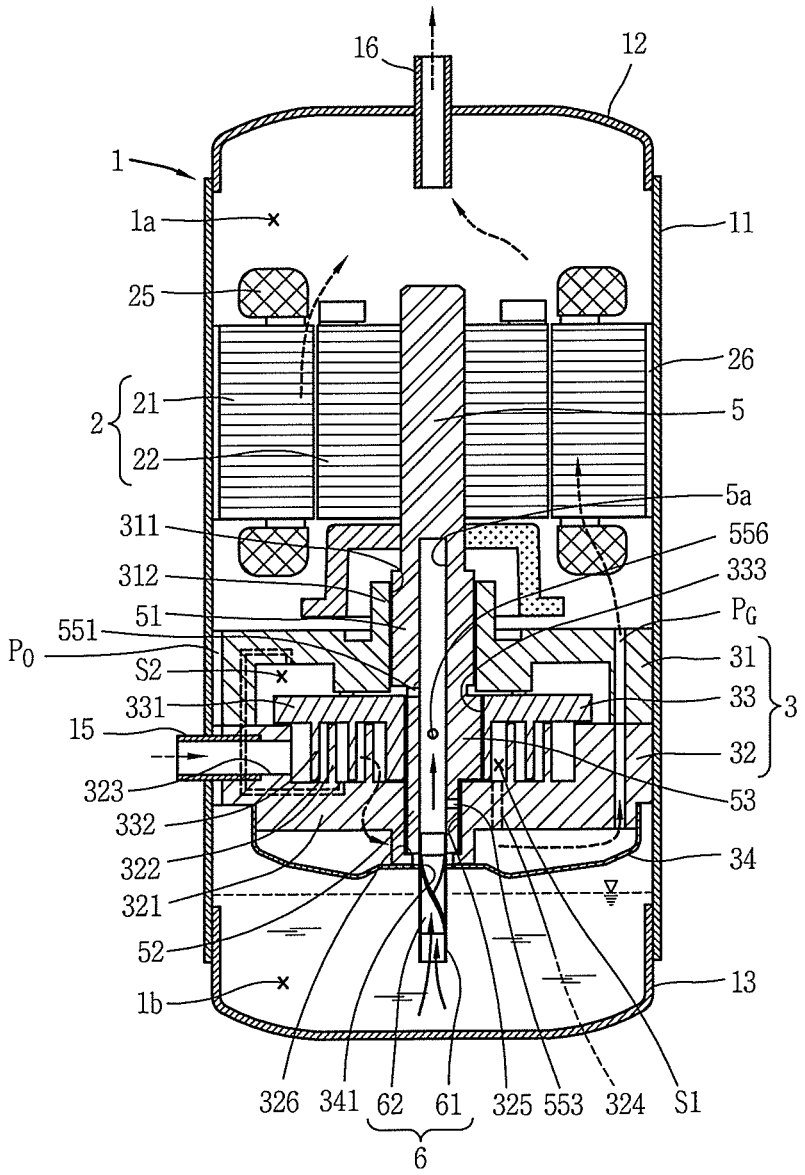
FIG. 1 is a longitudinal cross-sectional view of a bottom compression type scroll compressor according to an embodiment.

Hereinafter, description will be given in detail of a scroll compressor according to embodiments with reference to the accompanying drawings. Where possible, like reference numerals have been used to indicate like elements, and repetitive disclosure has been omitted.

Figure 2:
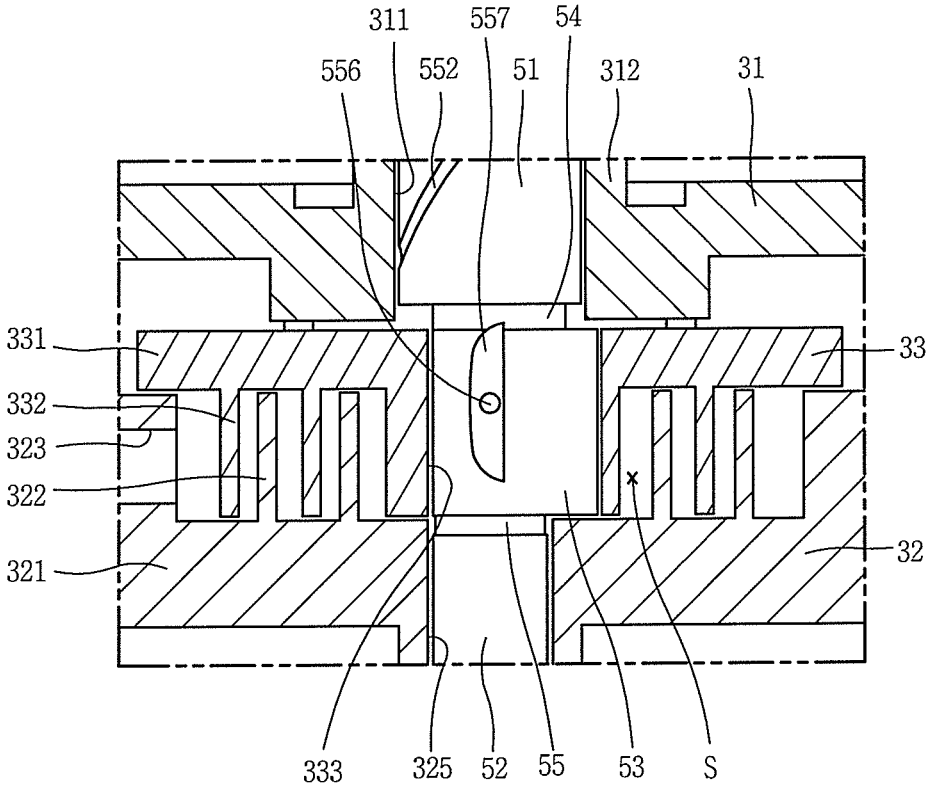
FIG. 2 is an enlarged partial longitudinal cross-sectional view of a compression device of the scroll compressor of FIG. 1.

With reference to FIGS. 1 and 2, a bottom compression type scroll compressor according to an embodiment may include a casing 1, a motor 2 provided within an inner space 1*a* of the casing 1 to generate a rotational force, and a compression unit or device 3 provided below the motor 2 to compress a refrigerant by receiving the rotational force transferred from the motor 2. The casing 1 may include a cylindrical shell 11 forming a hermetic container, an upper shell 12 that covers a top of the cylindrical shell 11 to form the hermetic container, and a lower shell 13 that covers a bottom of the cylindrical shell 11 to form the hermetic container and simultaneously form an oil storage space 1*b*.

A refrigerant suction pipe 15 may penetrate a side surface of the cylindrical shell 11 to communicate directly with a suction chamber of the compression device 3, and a refrigerant discharge pipe 16 that communicates with the inner space 1*a* of the casing 1 may be provided at a top of the upper shell 12. The refrigerant suction pipe 16 may form a path along which a compressed refrigerant, which may be discharged from the compression device 3 into the inner space 1*a* of the casing 1, may be discharged outside of the compressor. An oil separator (not illustrated), in which oil mixed with the discharged refrigerant may be separated from the refrigerant, may be connected to the refrigerant discharge pipe 16.

A stator 21 forming the motor 2 may be fixed to an upper portion of the casing 1. A rotor 22, which may form the motor 2 together with the stator 21 and may be rotated by interaction with the stator 21, may be rotatably provided within the stator 21. The stator 21 may include a plurality of slots (no reference numeral) formed on an inner circumferential surface thereof along a circumferential direction. A coil 25 may be wound around each of the plurality of slots. A passage 26 may be formed by, for example, cutting an outer circumferential surface of the stator 21 into a D-cut shape, such that refrigerant or oil may flow between the outer circumferential surface of the stator 21 and an inner circumferential surface of the cylindrical shell 11.

A main frame 31, which may form the compression device 3, may be provided below the stator 21 with a predetermined gap therebetween, and fixed to a lower side of the casing 1. A fixed scroll 32 (hereinafter, also referred to as a "first scroll") may be fixed to a lower surface of the main frame 31 with interposed therebetween an orbiting scroll 33 (hereinafter, also referred to as a "second scroll"), which may be eccentrically coupled to a rotational shaft 5 discussed hereinbelow. The orbiting scroll 33 may be installed between the main frame 31 and the fixed scroll 32 to perform an orbiting motion. The orbiting scroll 33 may form a pair of compression chambers S1, which may include a suction chamber, an intermediate pressure chamber, and a discharge chamber, along with the fixed scroll 32 while performing the orbiting motion. The fixed scroll 32 may be coupled to the main frame 31 to be movable up and down.

The main frame 31 may have an outer circumferential surface which may be, for example, shrink-fitted or welded into an inner circumferential surface of the cylindrical shell 11. A first bearing hole 311 may be formed through a center of the main frame 31 in an axial direction. A main bearing 51 of the rotational shaft 5, which may correspond to a first bearing, may be rotatably inserted into the first bearing hole 311 and supported thereby. A back pressure chamber S2, which may form a space along with the fixed scroll 32 and the orbiting scroll 33 so as to support the orbiting scroll 33 by pressure in the space, may be formed at a lower surface of the main frame 31.

The fixed scroll 32 may include a disk 321 formed in an approximately circular shape, and a fixed wrap 322, which may be formed on an upper surface of the disk 321 and engaged with the orbiting wrap 33 discussed hereinbelow so as to form the compression chambers S1. A suction opening 323, which may be connected to the refrigerant suction pipe 15, may be formed at one side of the fixed wrap 322. A discharge opening 324, which may communicate with the discharge chamber such that a compressed refrigerant may be discharged therethrough, may be formed through the disk 321.

As the discharge opening 324 may be formed to extend toward the lower shell 13, a discharge cover 34 may be coupled to a lower surface of the fixed scroll 32 so as to store the discharged refrigerant and guide it toward a refrigerant passage, which will be discussed hereinbelow. The discharge cover 34 may be coupled to the lower surface of the fixed scroll 32 in a sealing manner so as to separate a discharge passage (no reference numeral) of the refrigerant from the oil storage space 1*b*.

The discharge cover 34 may have an inner space, in which both the discharge opening 324 and an inlet of a refrigerant passage $P_G$ may be accommodated. The refrigerant passage $P_G$ may be formed through the fixed scroll 32 and the main frame 31 so as to guide a refrigerant, which may be discharged from the compression chamber S1 into the inner space of the discharge cover 34, toward the inner space 1*a* of the casing 1. The discharge cover 34 may be provided with a through hole 341, through which an oil feeder 6 may be inserted. The oil feeder 6 may be coupled to a sub bearing 52 of the rotationalshaft 5, which will be discussed hereinbelow, which may correspond to a second bearing, and sunk in the oil storage space 1*b* of the casing 1.

A second bearing hole 325, through which the sub bearing 52 of the rotationalshaft 5 may be penetratingly coupled, may be formed in an axial direction through a central portion of the disk 321 of the fixed scroll 32. A thrust bearing 326, which may support a lower end of the sub bearing 52 in the axial direction, may protrude from an inner circumferential surface of the second bearing hole 325.

The orbiting scroll 33 may include a disk 331 formed in an approximately circular shape, and an orbiting wrap 332 formed on a lower surface of the disk 331 and engaged with the fixed wrap 322 to form the compression chambers S1. A rotational shaft coupling portion 333, in which an eccentric portion 53 of the rotationalshaft 5, which will be discussed hereinbelow, may be rotatably inserted, may be formed in the axial direction through a central portion of the disk 331. An outer circumference of the rotationalshaft coupling portion 333 may be connected to the orbiting wrap 332 so as to form the compression chamber S1 along with the fixed wrap 322 during compression. The fixed wrap 322 and the orbiting wrap 332 may be formed in an involute shape, but also be formed in other various shapes.

The eccentric portion 53 of the rotationalshaft 5 discussed hereinbelow may be inserted into the rotationalshaft coupling portion 333, so as to overlap the orbiting wrap 332 or the fixed wrap 322 in a radial direction of the compressor. Accordingly, a repulsive force of a refrigerant may be applied to the fixed wrap 322 and the orbiting wrap 332 upon compression, and a compression force as a reaction force may be applied between the rotationalshaft coupling portion 333 and the eccentric portion 53. In such a manner, when the eccentric portion 53 of the rotationalshaft 5 penetrates through the disk 331 of the orbiting scroll 33 and overlaps the orbiting wrap 332 in the radial direction, the repulsive force and the compression force may be applied to a same plane based on the disk 331, thereby being attenuated by each other. This may result in preventing the orbiting scroll 33 from being inclined due to the applied compression force and repulsive force.

The rotationalshaft 5 may have an upper portion press-fitted into a center of the rotor 22 and a lower portion coupled to the compression device 3, so as to be supported in the radial direction. Accordingly, the rotationalshaft 5 may transfer a rotationalforce of the motor 2 to the orbiting scroll 33 of the compression device 3. The orbiting scroll 33, which may be eccentrically coupled to the rotationalshaft 5, may thus orbit with respect to the fixed scroll 32.

Figure 3:
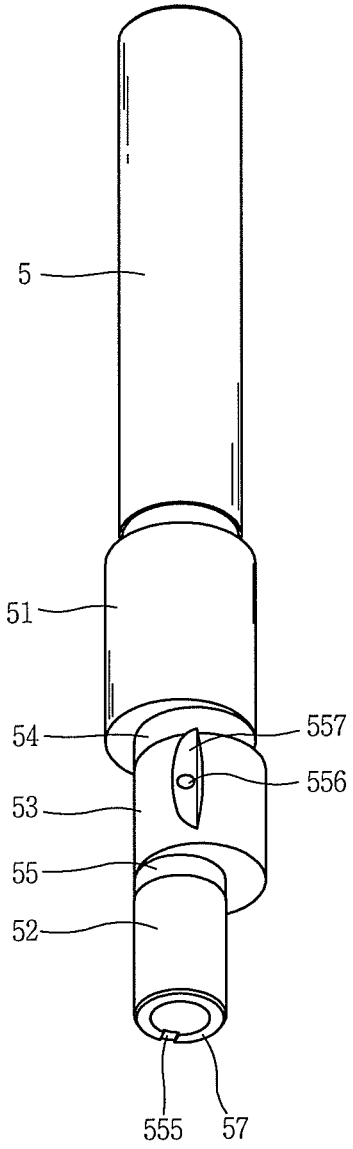
FIGS. 3 and 4 are perspective views illustrating first and second sides of a rotational shaft of the scroll compressor of FIG. 1.
Figure 4:
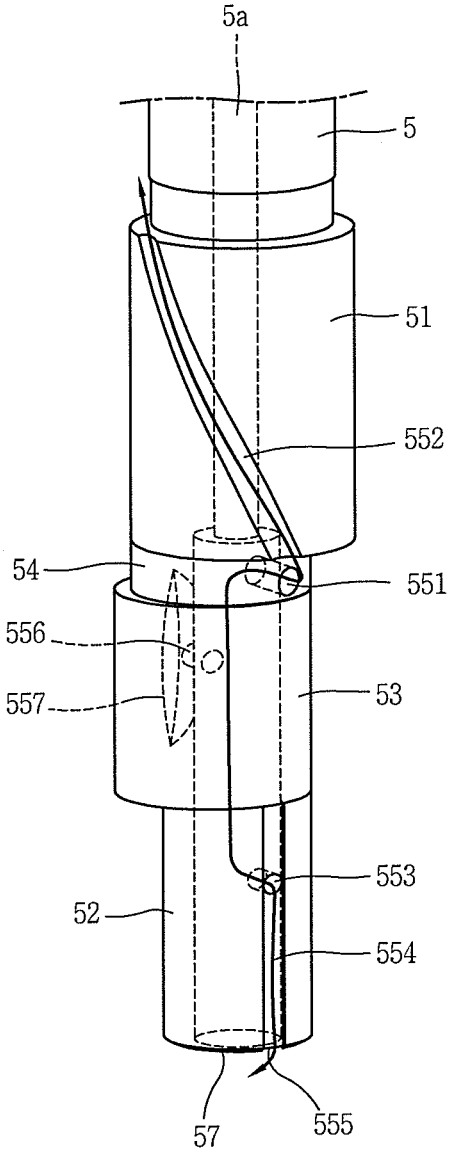
Figure 5:
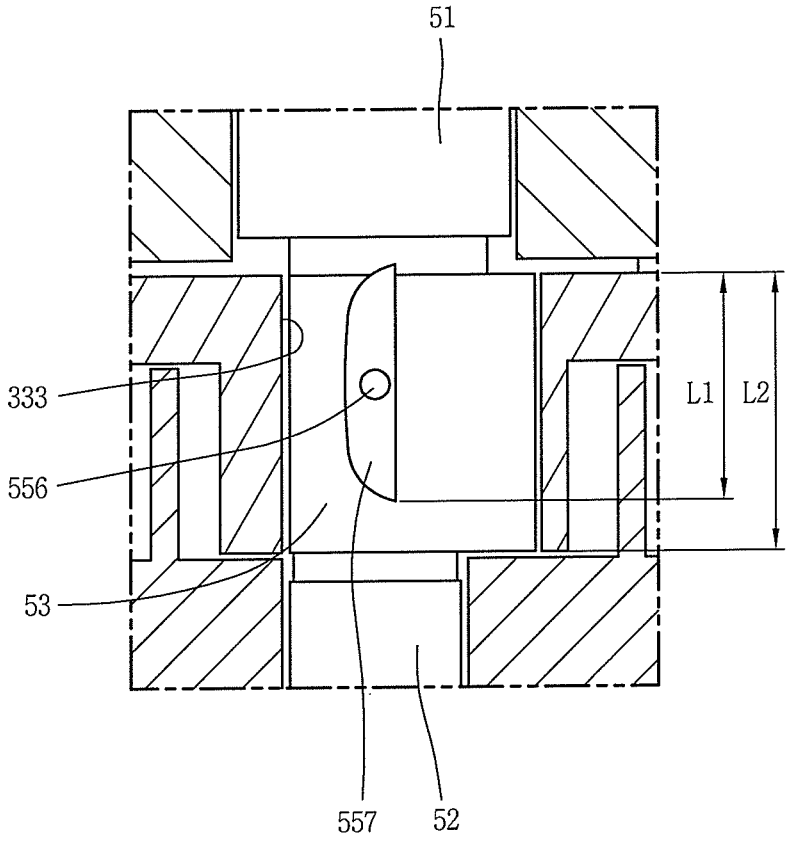
FIG. 5 is a front view illustrating a size of a third oil-feeding slit in the scroll compressor of FIG. 1.
Figure 6:
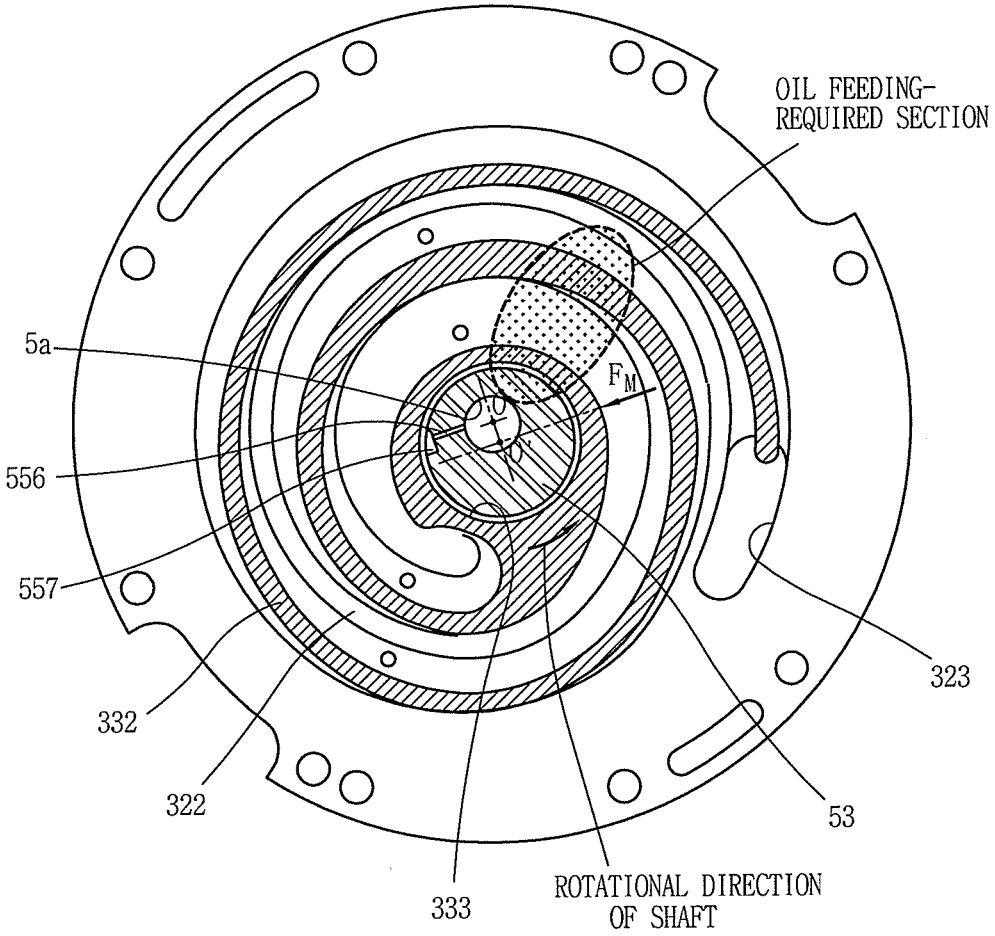
FIG. 6 is a horizontal cross-sectional view illustrating a relationship between a main gas force ($F_M$) and an oil feeding-required section between a fixed scroll and an orbiting scroll of the scroll compressor of FIG. 1.

As illustrated in FIGS. 3 and 4, the main bearing 51, which may be inserted into the first bearing hole 311 of the main frame 31 to be supported in the radial direction, may be formed at a lower portion of the rotationalshaft 5, and the sub bearing 52, which may be inserted into the second bearing hole 325 of the fixed scroll 32 to be supported in the radial direction may be formed at a lower side of the main bearing 51. The eccentric portion 53, which may be coupled to the rotationalshaft coupling portion 333 of the orbiting scroll 33 in an inserting manner may be formed between the main bearing 51 and the sub bearing 52. The main bearing 51 and the sub bearing 52 may be coaxially formed to have a same axial center, and the eccentric portion 53 may be eccentric from the main bearing 51 or the sub bearing 52 in the radial direction. Alternatively, the sub bearing 52 may also be formed to be eccentric from the main bearing 51.

The eccentric portion 53 may have an outer diameter which is smaller than an outer diameter of the main bearing 51 and greater than an outer diameter of the sub bearing 52, which may be advantageous in view of coupling the rotationalshaft 5 through the bearing holes 311, 312 and the rotationalshaft coupling portion 333. However, when the eccentric portion 53 is not integrally formed with the rotationalshaft 5, but rather, is formed using a separate bearing, the insertion of the rotationalshaft 5 for coupling may be enabled even though the outer diameter of the sub bearing 52 is not smaller than the outer diameter of the eccentric portion 53.

An oil passage 5*a*, through which oil may be supplied to each bearing and the eccentric portion 53, may be formed within the rotationalshaft 5. As the compression device 3 is located lower than the motor 2, the oil passage 5*a* may be formed in a recessed manner from a lower end of the rotationalshaft 5 up to an approximately lower end or an intermediate height of the stator 21, or up to a height higher than an upper end of the main bearing 51.

The oil feeder 6 to pump up oil filled in the oil storage space 1*b* may be coupled to a lower end of the rotationalshaft 5, namely, a lower end of the sub bearing 52. The oil feeder 6 may be provided with an oil supply pipe 61, which may be inserted into the oil passage 5*a* of the rotationalshaft 5 for coupling, and an oil sucking member 62, such as a propeller, which may be inserted into the oil supply pipe 61 to suck up the oil. The oil supply pipe 61 may be inserted through the through hole 341 of the discharge cover 34 so as to be submerged in the oil storage space 1*b*.

An oil-feeding hole and/or an oil-feeding slit may be formed at each of the bearings and the eccentric portion or between the bearings, such that the oil suck up through the oil passage 5*a* may be supplied to outer circumferential surfaces of each of the bearings and the eccentric portion. For example, as illustrated in FIGS. 2 to 5, a first small-diameter portion 54, which allows the main bearing 51 and the eccentric portion 53 to be spaced apart from each other by a predetermined interval, may be provided at a lower side of the main bearing 51. The first small-diameter portion 54 may be provided with a first oil-feeding hole 551 which communicates with the oil passage 5*a* and penetrate through an outer circumferential surface of the first small-diameter portion 54. A first oil-feeding slit 552 may be spirally formed along an outer circumferential surface of the main bearing 51, such that oil supplied to the first small-diameter portion 54 through the first oil-feeding hole 551 may flow upward along the outer circumferential surface of the main bearing 51. Accordingly, oil, which flows up along the first oil-feeding slit 552 up to an upper end of the main bearing 51, may then flow over through a first shaft receiving portion 312 provided with the first bearing hole 311 of the main frame 31. The oil may then flow along an upper surface of the main frame 31, and thereby be recycled into the oil storage space 1*b* through an oil passage $P_O$. However, as the oil is introduced into the first small-diameter portion 54 through a third oil-feeding hole and a third oil-feeding slit discussed hereinbelow, the first oil-feeding hole 551 may not be formed. Instead of it, the oil introduced into the first small-diameter portion 54 through the third oil-feeding hole and the third oil-feeding slit may be guided into the first oil-feeding slit 552.

A second oil-feeding hole 553, which may communicate with the oil passage 5*a* at an upper portion of the sub bearing 52, may be formed through an outer circumferential surface of the sub bearing 52. A second oil-feeding slit 554, which may communicate with the second oil-feeding hole 553, may be formed to extend along the outer circumferential surface of the sub bearing 52 in an up and down or vertical direction. An upper end of the second oil-feeding slit 554 may communicate with a second small-diameter portion 55, which may be provided between the sub bearing 52 and the eccentric portion 53, and a lower end of the second oil-feeding slit 554 may communicate with a communication slit 555 provided at or in an axial plate 57, which may be disposed at a lower end of the sub bearing 52, namely, at a lower end of the rotationalshaft 5 to be supported by a periphery of the through hole 341 of the discharge cover 34. The communication slit 555 may communicate with a lower surface of the axial plate 57 in the radial direction. Positions of the second oil-feeding hole 553 and the second oil-feeding slit 554 may vary, and also, the second oil-feeding slit 554 may be implemented in various shapes, such as a spiral shape, for example.

Still referring to FIGS. 2 to 5, the eccentric portion 53 may be provided with a third oil-feeding hole 556, which may communicate with the oil passage 5*a* and penetrate through the outer circumferential surface of the eccentric portion 53, and a third oil-feeding slit 557, which may communicate with the third oil-feeding hole 556 and which may be recessed along the outer circumferential surface of the eccentric portion 53 in the up and down or verticaldirection. The third oil-feeding hole 556 may be formed in the radial direction, as illustrated in the drawings, but in some cases, may be inclined or curved in a forward direction with respect to the rotationaldirection of the rotationalshaft 5. Also, the third oil-feeding slit 557 may be formed in a lengthwise direction, as illustrated in the drawings, but in some cases, may be formed inclined or spiral along the lengthwise direction. In addition, the third oil-feeding slit 557 may have one end open to communicate with the first small-diameter portion 54, as illustrated in the drawings, but in some cases, may have a structure with both ends closed. The first small-diameter portion 54 or the main bearing 51 may be provided with the first oil-feeding hole 551.

The eccentric portion 53 may form a third bearing. As the eccentric portion 53 is formed eccentric from a center of the rotational shaft 5 at a position where it overlaps the orbiting wrap 332 in the radial direction, a bearing area of the eccentric portion 53 may be optimally designed by taking into account a relationship with a pressure ratio. Therefore, it may be important with respect to reliability or efficiency of the compressor that the third oil-feeding hole 556 and the third oil-feeding slit 557 be formed at positions and in shapes to allow quick, smooth oil supply, in comparison to other oil-feeding holes or oil-feeding slits.

Figure 7:
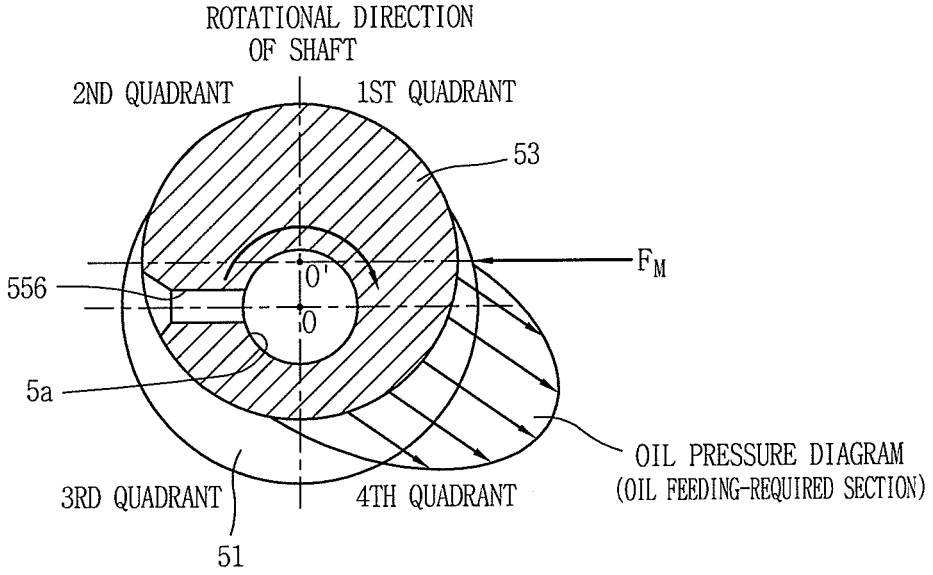
FIG. 7 is a schematic view illustrating an appropriate position of an oil-feeding hole in FIG. 6.

For example, the third oil-feeding hole 556 or the oil-feeding slit 557 may be located at a closest position to an, oil feeding-required section. Namely, as illustrated in FIG. 7, if the rotational shaft 5 is rotated in a clockwise direction and a pressing direction to which a main gas force FM is applied is a positive coordinate axis in a horizontal direction, the oil-feeding hole 556 or the oil-feeding slit 557 may be formed to he located on or in a first (1/4) quadrant or a third (3/4)quadrant. That is, when the rotational shaft 5 is rotated in a clockwise direction centering on a center 0 of the rotational shaft 5 in the scroll compressor, a pressing direction to which the main gas force FM is applied is orthogonal to the rotational direction based on a line that connects the center 0 of the rotational shaft 5 to a center 0' of the eccentric portion 53. Accordingly, an oil pressure diagram is formed within a range of about 90° to 180° in the rotational direction based on the line that connects the center of the rotational shaft 5 and the center of the eccentric portion 53, thereby forming the oil feeding-required section. However, if the third oil-feeding hole 556 or third oil-feeding slit 557 is formed within the oil feeding-required section, internal pressure of the oil feeding-required section may he higher than internal pressure of the oil passage 5*a*, which may prevent the oil within the oil passage 5*a* from being discharged out of the eccentric portion 53. Therefore, an outlet of the third oil-feeding hole 556 or the oil-feeding slit 557 may be formed outside of the oil feeding-required section, if possible. However, if the outlet of the third oil-feeding hole 556 or the oil-feeding slit 557 is located too far away from the Oil feeding-required section, namely, located within the second (2/4) quadrant in FIG. 7, it may extend a time which is taken for the oil discharged out of the eccentric portion 53 though the third oil-feeding hole 556 to flow into the oil feeding-required section. This may cause a bearing performance to be reduced by that much, thereby causing abrasion or increasing friction loss. Therefore, the third oil-feeding hole 556 or the oil-feeding slit 557 may be formed in the first (1/4) or third (3/4) quadrant, which is close to the oil feeding-required section without being in the oil feeding-required section. Based on the line that connects the center 0 of the rotational shaft 5 and the center 0' of the eccentric, portion 53, the third oil-feeding hole 556 may be formed in the range of about 0° to 90° or in a range of about 180° to 270° in the rotational direction of the rotational shaft 5. This exemplary embodiment limits the position of the third oil-feeding hole, illustrating the example that the third oil-feeding slit communicates with the third oil-feeding hole. However, in a case in which the third oil-feeding slit 557 does not communicate with the third oil-feeding hole 556, more specifically, in a case in which only the third oil-feeding slit 557 is formed on the outer circumferential surface of the eccentric portion 53, the position of the third oil-feeding slit 557 may be the same as or similar to the aforementioned position of the third oil-feeding hole 556.

Figure 8:
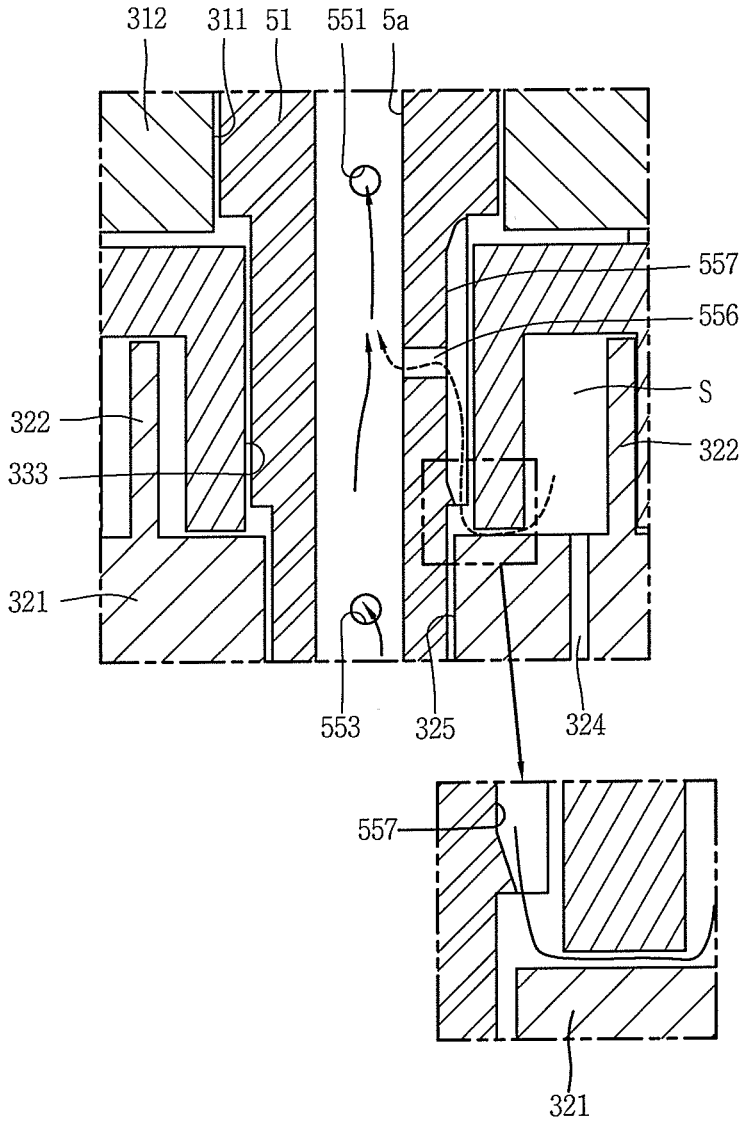
Figure 9:
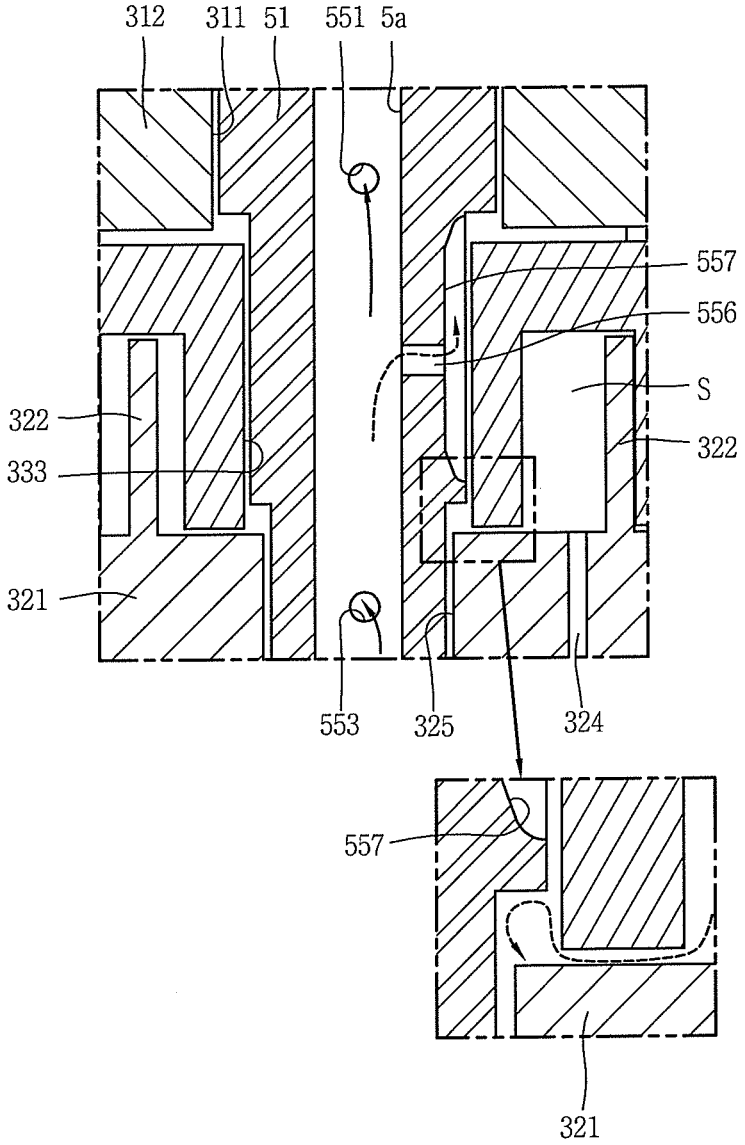

Referring to FIGS. 8 and 9, as the third oil-feeding hole 556 may be formed through the outer circumferential surface of the eccentric portion 53, at least a portion of the third oil-feeding slit 557 may be exposed to the outside of the rotationalshaft coupling portion 333, in order to allow the oil flowing along the oil passage 5*a* to be smoothly introduced into the third oil-feeding hole 556. This exemplary embodiment illustrates the third oil-feeding slit 557 as extending in a lengthwise direction of the eccentric portion 53. An upper end of the third oil-feeding slit 557 may communicate with the first small-diameter portion 54 by opening an edge of an upper end of the eccentric portion 53 in a recessing manner, and a lower end of the third oil-feeding slit 557 may be formed to be separated from the second small-diameter portion 55 by blocking a lower end of the third oil-feeding slit 557 in a manner of leaving an edge of a lower end of the eccentric portion 53, namely, an end portion adjacent to an end of the orbiting wrap in the axial direction. To this end, a length L1 of the third oil-feeding slit 557 in the axial direction may be shorter than a length L2 of the eccentric portion 53 in the axial direction.

Consequently, the third oil-feeding hole 556 may communicate with an intermediate pressure area, which may be formed at a rear surface of the orbiting scroll 33, through the open upper end of the third oil-feeding slit 557. This may allow the oil of relative high pressure flowing within the oil passage 5*a* to be smoothly moved into the third oil-feeding hole 556 and the third oil-feeding slit 557. As the lower end of the third oil-feeding slit 557 may be blocked, the oil within the third oil-feeding slit 557 may be prevented from flowing toward the sub bearing 52, and the oil flowing along the oil passage 5*a* may smoothly flow toward the third oil-feeding slit 557 through the third oil-feeding hole 556. That is, referring to FIG. 8, when the lower end of the third oil-feeding slit 557 is open, the oil contained in the third oil-feeding slit 557 may flow down due to its own weight, and accordingly, the eccentric portion 53 may not be effectively lubricated. In addition, a refrigerant of high pressure leaked from the compression chamber S1 may move toward the third oil-feeding hole 556 through the third oil-feeding slit 557 to accordingly block the second oil-feeding hole 556. Accordingly, a difference between internal and external pressure of the third oil-feeding hole 556 may not be generated, or the external pressure may be rather high such that the oil flowing in the oil passage 5*a* may be prevented from being discharged out of the third oil-feeding slit 557. However, referring to FIG. 9, if the lower end of the third oil-feeding slit 557 facing the compression chamber S1 is blocked, the oil within the third oil-feeding slit 557 may be prevented from flowing down to the sub bearing 52 and the refrigerant of high pressure compressed in the compression chamber S1 may be prevented from being introduced into the third oil-feeding slit 556. This may allow the oil flowing along the oil passage 5*a* to be smoothly discharged into the third oil-feeding slit 557 through the third oil-feeding hole 556.

Figure 10:
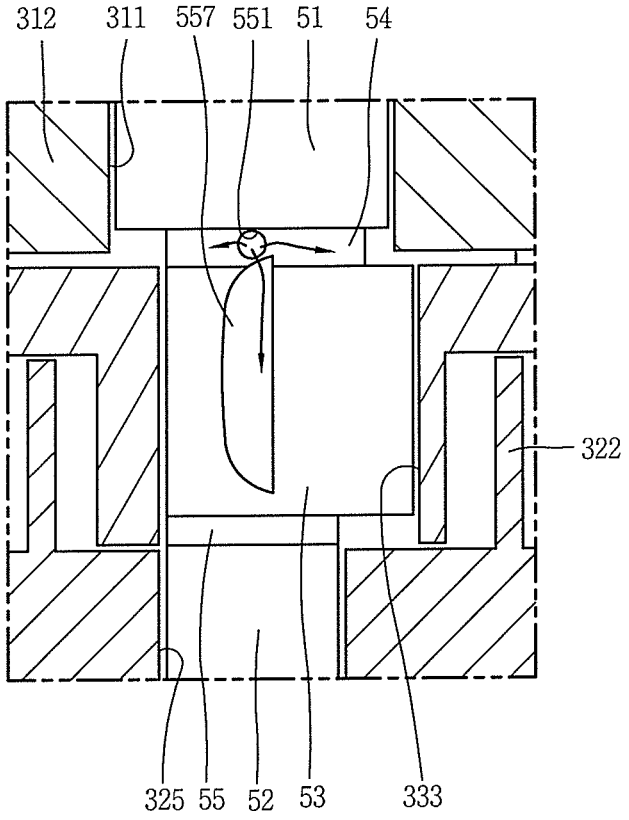
FIG. 10 is a longitudinal partial cross-sectional view illustrating a case in which an oil-feeding hole is not formed on an eccentric portion of the scroll compressor of FIG. 1.

The third oil-feeding slit 557 may be formed to communicate with the outlet of the third oil-feeding hole 556; however, alternatively, referring to FIG. 10, only the third oil-feeding slit 557 may be formed without the third oil-feeding hole 556. With this structure, a portion of oil discharged out through the first oil-feeding hole 551, which is formed through the first small-diameter portion 54, may flow into the third oil-feeding slit 557, so as to lubricate a bearing surface between the eccentric portion 53 and the rotationalshaft coupling portion 333.

The foregoing embodiments have illustrated that the end portion of the oil-feeding slit, which is adjacent to the end of the orbiting wrap in the axial direction, is formed integrally with a type of blocking portion when the oil-feeding slit is formed. However, this exemplary embodiment illustrates that the blocking portion may be formed by closing a low end of the oil-feeding slit in a manner of inserting a separate blocking member in the eccentric portion.

Figure 11:
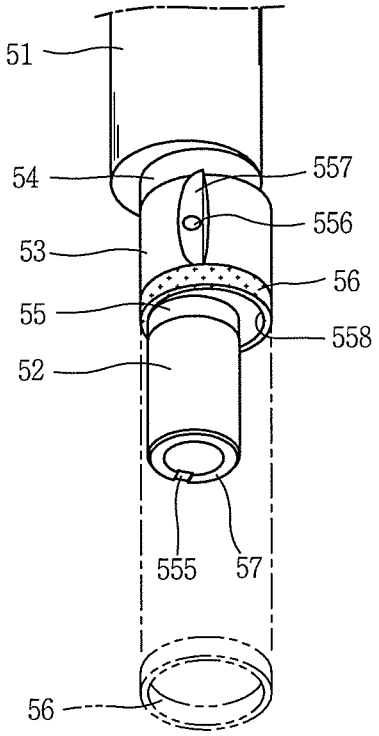
FIG. 11 is a perspective view illustrating of an embodiment for which one end portion of the oil-feeding slit is blocked by coupling a blocking member to an eccentric portion in a scroll compressor.

FIG. 11 is a perspective view illustrating an embodiment for which one end of the oil-feeding slit is blocked by coupling a blocking member to an eccentric portion in a scroll compressor. As illustrated in FIG. 11, an annular stop 558 may be formed at one end portion of the eccentric portion 53, namely, an end portion adjacent to an end of the orbiting wrap (hereinafter, referred to as a "fixed scroll-side end portion"), and an oil-feeding slit 557 may be formed to extend from the annular stop 558 to the other end of the eccentric portion 53.

A block 56, which may be formed in an annular shape, may be press-fitted onto the annular stop 558 so as to block the fixed scroll-side end portion of the oil-feeding slit 557, thereby forming a type of blocking portion or block. A thickness of the block 56 may be the same as or slightly thinner than a depth of the annular stop 558, to prevent lowering of a bearing performance. The block 56 may be thick enough such that its outer circumferential surface is located higher than a bottom of the oil-feeding slit 557, in order to block the fixed scroll-side end portion of the oil-feeding slit 557.

Although not illustrated, the block may also be formed in any shape, if it can block the one end of the oil-feeding slit. For example, it may be formed in a block shape other than the annular shape so as to be adhered onto the oil-feeding slit, or may be formed in a shape of a screw such that a screw head may serve as the block.

Meanwhile, another embodiment of a scroll compressor will be described hereinafter. That is, the foregoing embodiment has illustrated an oil supply structure in a bottom compression type scroll compressor in which a compression device is located beneath a motor unit or motor. However, this exemplary embodiment illustrates that the oil supply structure is equally applicable to a top compression type scroll compressor in which the compression device is located above the motor.

Figure 12:
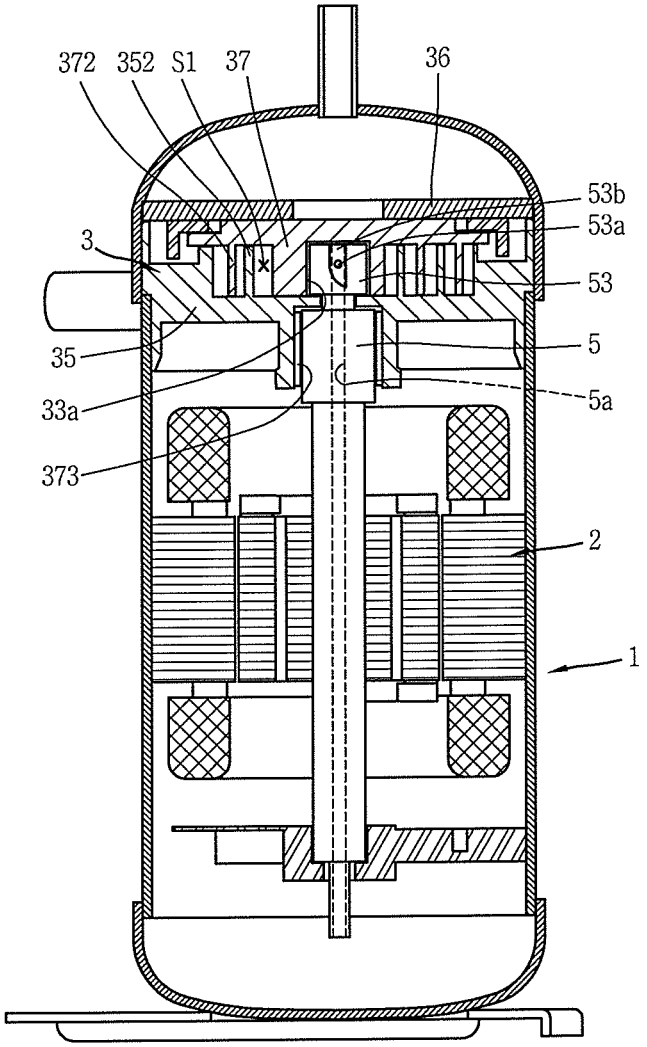
FIG. 12 is a longitudinal cross-sectional view of a top compression type scroll compressor according to an embodiment.

A top compression type scroll compressor disclosed herein, as illustrated in FIG. 12, may include motor 2 installed at a lower side within casing 1, and compression device 3 located above the motor 2. The compression device 3 may include a frame having fixed wrap 352 and fixed to the casing 1, plate 36 coupled to an upper surface of frame 35, and orbiting scroll 37 having orbiting wrap 372 provided between the frame 35 and the plate 36 and engaged with the fixed wrap 352 to form a pair of compression chambers S1.

The orbiting scroll 37 may be provided with rotational shaft coupling portion 373, to which eccentric portion 53 of rotationalshaft 5 coupled to a rotor of the motor 2 may be eccentrically coupled. The rotationalshaft coupling portion 373 may be formed such that the eccentric portion 53 overlaps the compression chambers S1 in a radial direction.

Oil passage 5*a* may be formed to extend upwardly in the rotationalshaft 5 from a lower end of the rotationalshaft 5. The oil passage 5*a* may be formed from the lower end of the rotationalshaft 5 up to a predetermined height, namely, up to a middle position of the eccentric portion 53. The eccentric portion 53 may be provided with oil-feeding hole 53*a* which may communicate with the oil passage 5*a* and penetrate through the outer circumferential surface of the eccentric portion 53, and oil-feeding slit 53*b* formed on the outer circumferential surface of the eccentric portion 53 to communicate with the oil-feeding hole 53*a*.

The oil-feeding slit 53*b* may be formed to extend or be inclined in an up and down or vertical direction. A lower end of the oil-feeding slit 53*b*, namely, an end portion adjacent to an end of orbiting wrap 572 in an axial direction may be blocked, such that oil discharged out of the oil-feeding slit 53*b* cannot flow down, and simultaneously, a high pressure refrigerant discharged from the compression chambers S1 may be prevented from being introduced into the oil-feeding slit 53*b*. To this end, a length of the oil-feeding slit 53*b* in an axial direction may be shorter than a length of the eccentric portion 53 in the axial direction.

Based on a line that connects a center of the rotationalshaft 5 and a center of the eccentric portion 53, as illustrated in the previous embodiment, the oil-feeding hole 53*a* or the oil-feeding slit 53*b* may be formed in a range of about 0° to 90° or in a range of about 180° to 270° in a rotationaldirection of the rotationalshaft 5. A position of the oil-feeding hole and a shape of the oil-feeding slit illustrated in this embodiment may be similar to the position of the third oil-feeding hole and the shape of the third oil-feeding slit illustrated with respect to the previous embodiment.

Also, the thusly-obtained operation effects of this embodiment may be similar to those illustrated with respect to the previous embodiment. Therefore, detailed description thereof has been omitted.

Embodiments disclosed herein provide a scroll compressor capable of allowing oil to be smoothly supplied between an eccentric portion of a rotational shaft and a rotational shaft coupling portion of an orbiting scroll by preventing introduction of a high pressure refrigerant between the eccentric portion and the rotational shaft coupling portion.

Embodiments disclosed herein further provide a scroll compressor, in which an oil-feeding hole or an oil-feeding slit is located at a position allowing oil to be quickly supplied into an oil feeding-required section.

Embodiments disclosed herein provide a scroll compressor that may include a casing, a motor unit or motor disposed in an inner space of the casing, a frame that is fixed to the inner space of the casing at one side of the motor unit, a fixed scroll that is fixed to the frame and provided with a fixed wrap, an orbiting scroll that is located between the frame and the fixed scroll and having an orbiting wrap engaged with the fixed wrap of the fixed scroll to form compression chambers, the orbiting scroll performing an orbiting motion, and a rotational shaft that is coupled to the orbiting scroll and provided with an eccentric portion eccentrically coupled to the orbiting scroll, wherein the eccentric portion overlaps the orbiting wrap in a radial direction. An oil-feeding slit may be formed on an outer circumferential surface of the eccentric portion, and at least one of both end portions of the oil-feeding slit in an axial direction may be blocked.

The oil-feeding slit may be formed such that an end portion thereof at a side of the fixed scroll is blocked. Further, the oil-feeding slit may be formed such that an end portion thereof, adjacent to an end of the orbiting wrap of the orbiting scroll in the axial direction, is blocked.

The rotational shaft may be provided with a first bearing portion or first bearing supported on the frame, and a second bearing portion or second bearing supported on the fixed scroll. The eccentric portion may be located between the first bearing portion and the second bearing portion, and the oil-feeding slit may be formed such that an end portion thereof at a side of the second bearing portion is blocked. The rotational shaft may be provided with an oil passage formed therein, and the eccentric portion may be provided with an oil-feeding hole through which the oil passage may communicate with the oil-feeding slit.

The oil-feeding hole may be formed in a range of about 0° to 90° or in a range of about 180° to 270° along a rotational direction of the rotational shaft, based on a line that connects an axial center of the rotational shaft and a center of the eccentric portion. The oil-feeding slit may be formed in a range of about 0° to 90° or in a range of about 180° to 270° along the rotational direction of the rotational shaft, based on the line that connects the axial center of the rotational shaft and the center of the eccentric portion.

Embodiments disclosed herein further provide a scroll compressor that may include a casing, a motor unit or motor that is provided in an inner space of the casing, a frame that is fixed to the inner space of the casing at one side of the motor unit, a fixed scroll that is fixed to the frame and provided with a fixed wrap, an orbiting scroll that is located between the frame and the fixed scroll and having an orbiting wrap engaged with the fixed wrap of the fixed scroll to form compression chambers, the orbiting scroll performing an orbiting motion, and a rotational shaft that is coupled to the orbiting scroll and provided with an eccentric portion eccentrically coupled to the orbiting scroll, wherein the eccentric portion overlaps the orbiting wrap in a radial direction. An oil-feeding slit may be formed on an outer circumferential surface of the eccentric portion, and one side of the oil-feeding slit in an axial direction may be blocked by a blocking member or block coupled to the eccentric portion.

An annular stopped portion or stopmay be formed on an outer circumferential surface of the eccentric portion, and the blocking member may be inserted on the annular stopped portion for coupling. The blocking member may be coupled to a fixed scroll-side end portion of the oil-feeding slit based on a center of the oil-feeding slit in an axial direction.

The rotational shaft may be provided with an oil passage formed therein, and the eccentric portion may be provided with an oil-feeding hole through which the oil passage may communicate with the oil-feeding slit. The oil-feeding hole may be formed in a range of about 0° to 90° or in a range of about 180° to 270° along a rotational direction of the rotational shaft, based on a line that connects an axial center of the rotational shaft and a center of the eccentric portion. The oil-feeding slit may be formed in a range of about 0° to 90° or in a range of about 180° to 270° along the rotational direction of the rotational shaft, based on the line that connects the axial center of the rotational shaft and the center of the eccentric portion.

Embodiments disclosed herein additionally provide a scroll compressor that may include a frame, a first scroll that is supported on the frame, a second scroll that is provided between the frame and the first scroll and configured to perform an orbiting motion, and a rotational shaft that is eccentrically coupled to the second scroll and provided with an oil passage formed therein in a lengthwise direction thereof. The rotational shaft may include a first bearing portion or first bearing that is coupled to the frame, a second bearing portion or second bearing that is coupled to the first scroll, and a third bearing portion or third bearing that is located between the first bearing portion and the second bearing portion, and eccentrically provided on the first bearing portion to overlap a wrap of the second scroll in a radial direction. An oil-feeding slit that communicates with the oil passage may be formed on an outer circumferential surface of the third bearing portion. A length of the oil-feeding slit in an axial direction may be shorter than a length of the third bearing portion in the axial direction.

A frame-side end portion of the oil-feeding slit may be formed to extend up to an edge of one side of the third bearing portion, and a first scroll-side end portion of the oil-feeding slit may be formed by being spaced apart from an edge of the other side of the third bearing portion by a predetermined interval. The oil-feeding slit may be formed such that an end portion thereof, adjacent to an end of the wrap of the second scroll in the axial direction is blocked. The oil-feeding slit may be formed in a range of about 0° to 90° or in a range of about 180° to 270° along a rotational direction of the rotational shaft, based on a line that connects an axial center of the rotational shaft and a center of the third bearing portion.

Embodiments disclosed herein also provide a scroll compressor that may include a casing, a motor unit or motor that is disposed in an inner space of the casing, a frame that is fixed to the inner space of the casing at one side of the motor unit, and provided with a fixed wrap that protrudes in a direction opposite to a direction that the motor unit is located, a plate that is fixed to the frame, an orbiting scroll that is located between the frame and the plate, and has an orbiting wrap engaged with the fixed wrap of the frame to form compression chambers, the orbiting scroll performing an orbiting motion, a rotational shaft that is provided with an oil passage formed therein, and an eccentric portion eccentrically coupled to the orbiting scroll, wherein the eccentric portion overlaps the orbiting wrap in a radial direction. An oil-feeding slit that communicates with the oil passage may be provided on an outer circumferential surface of the eccentric portion. One end portion, which is adjacent to an end of the orbiting wrap of the orbiting scroll in the axial direction, of both end portions of the oil-feeding slit in an axial direction may be blocked. The oil-feeding slit may be formed in a range of about 0° to 90° or in the range of about 180° to 270° along a rotational direction of the rotational shaft, based on a line that connects an axial center of the rotational shaft and a center of the eccentric portion.

A scroll compressor disclosed herein may prevent an oil-feeding hole from being blocked due to a high pressure refrigerant, which is compressed in compression chambers and introduced into the oil-feeding hole through an oil-feeding slit, by blocking one of both end portions of the oil-feeding slit, adjacent to the compression chambers, when the oil-feeding hole is formed through an outer circumferential surface of a bearing and the oil-feeding slit that communicates with the oil-feeding hole is formed on the outer circumferential surface. This may allow for smooth oil supply onto the outer circumferential surface of the bearing through the oil-feeding hole, thereby enhancing a bearing performance.

Also, the oil-feeding hole or slit may be formed at a closest position to an oil feeding-required section, not within the section. This may allow for quick oil supply into the oil feeding-required section, resulting in further enhancing of the bearing performance.

As features may be embodied in several forms without departing from characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A scroll compressor, comprising:

a casing;

a motor disposed in an inner space of the casing;

a frame fixed in the inner space of the casing at one side of the motor;

a fixed scroll fixed to the frame and provided with a fixed wrap;

an orbiting scroll located between the frame and the fixed scroll and having an orbiting wrap engaged with the fixed wrap of the fixed scroll to form compression chambers, wherein the orbiting scroll performs an orbiting motion; and a rotational shaft coupled to the orbiting scroll and provided with an eccentric portion eccentrically coupled to the orbiting scroll, wherein the eccentric portion overlaps the orbiting wrap in a radial direction, and wherein an oil-feeding slit is formed on an outer circumferential surface of the eccentric portion, and at least one end of the oil-feeding slit in an axial direction blocks a flow of high pressure refrigerant from the compression chambers along the oil feeding slit, wherein the rotational shaft is provided with an oil passage formed therein, wherein the eccentric portion is provided with an oil-feeding hole through which the oil passage communicates with the oil-feeding slit, and wherein the oil-feeding hole is formed in a range of 0° to 900° or in a range of 180° to 270° along a rotational direction of the rotational shaft, based on a line that connects an axial center of the rotational shaft and a center of the eccentric portion.

2. The scroll compressor of claim 1, wherein an end of the oil-feeding slit at a side of the fixed scroll is blocked.

3. The scroll compressor of claim 1, wherein an end portion of the oil-feeding slit adjacent to an end of the orbiting wrap of the orbiting scroll in the axial direction is blocked.

4. The scroll compressor of claim 1, wherein the rotational shaft is provided with a first hearing supported on the frame, and a second bearing supported on the fixed scroll, wherein the eccentric portion is located between the first bearing and the second hearing, and wherein an end of the oil-feeding slit at a side of the second bearing is blocked.

5. The scroll compressor of claim 1, wherein the oil-feeding slit is formed in a range of 0° to 90° or in a range of 180° to 270° along a rotational direction of the rotational shaft, based on a line that connects an axial center of the rotational shaft and a center of the eccentric portion.

6. A scroll compressor, comprising;

a casing;

a motor provided in an inner space of the casing;

a frame fixed in the inner space of the casing at one side of the motor;

a fixed scroll fixed to the frame and provided with a fixed wrap;

an orbiting scroll located between the frame and the fixed scroll and having an orbiting wrap engaged with the fixed wrap of the fixed scroll to form compression chambers, wherein the orbiting scroll performs an orbiting motion; and a rotational shaft coupled to the orbiting scroll and provided with an eccentric portion eccentrically coupled to the orbiting scroll, wherein the eccentric portion overlaps the orbiting wrap in a radial direction, wherein an oil-feeding slit is formed on an outer circumferential surface of the eccentric portion, and one end of the oil-feeding slit in an axial direction is blocked by a block coupled to the eccentric portion, and wherein the oil-feeding slit is formed in a range of 0° to 90° or in a range of 180° to 270° along a rotational direction of the rotational shaft, based on a line that connects an axial center of the rotational shaft and a center of the eccentric portion.

7. The scroll compressor of claim 6, wherein an annular stop is formed on an outer circumferential surface of the eccentric portion, and wherein the block is inserted onto the annular stop to be coupled thereto.

8. The scroll compressor of claim 6, Wherein the block is coupled to a fixed scroll-side end of the oil-feeding slit based on a center of the oil-feeding slit in an axial direction.

9. The scroll compressor of claim 6, wherein the rotational shaft is provided with an oil passage formed therein, and wherein the eccentric portion is provided with an oil-feeding hole through which the oil passage communicates with. the oil-feeding slit.

10. The scroll compressor of claim 9, wherein the oil-feeding hole is formed in a range of 0° to 90° or in a range of 180° to 270° along a rotational direction of the rotational shaft, based on a line that connects an axial center of the rotational shaft and a center of the eccentric portion.

11. A scroll compressor, comprising:

a frame;

a first scroll supported on the frame;

a second scroll provided between the frame and the first scroll and configured to perform an orbiting motion; and a rotational shaft eccentrically coupled to the second scroll and provided with an oil passage formed therein in a lengthwise direction thereof, wherein the rotational shaft comprises:

a first bearing coupled to the frame;

a second bearing coupled to the first scroll; and a third bearing located between the first bearing and the second bearing, and eccentrically provided on the first bearing to overlap a wrap of the second scroll in a radial direction, wherein an oil-feeding slit, which communicates with the oil passage, is formed on an outer circumferential surface of the third bearing, wherein a length of the oil-feeding slit in an axial direction is shorter than a length of the third bearing in the axial direction at a blocking portion, wherein the blocking portion is provided between the compression chambers and the outer circumferential surface of the eccentric portion, and wherein the oil-feeding slit is formed in a range of 0° to 90° or in a range of 180° to 270° along a rotational direction of the rotational shaft, based on a line that connects an axial center of the rotational shaft and a center of the third bearing.

12. The scroll compressor of claim 11, wherein a frame-side end of the oil-feeding slit is formed up to an edge of a first side of the third bearing, and a first scroll-side end of the oil-feeding slit is formed by being spaced apart from an edge of a second of the third bearing by a predetermined interval.

13. The scroll compressor of claim 11, wherein an end of the oil-feeding slit adjacent to an end of the wrap of the second scroll in the axial direction is blocked.

* * * * *